United States Patent [19]

Kemmel

[11] 4,350,171

[45] Sep. 21, 1982

[54] ARRANGEMENT FOR HOLDING CIGARETTES

[76] Inventor: Alexander Kemmel, 2300 Madison St., Apt. 202, Hollywood, Fla. 33020

[21] Appl. No.: 196,872

[22] Filed: Oct. 14, 1980

[51] Int. Cl.[3] ..... A24F 19/10

[52] U.S. Cl. ..... 131/234; 131/329; 312/73; 206/250

[58] Field of Search ..... 131/234, 329; 312/73, 312/78, 83; 221/136; 206/249, 250

[56] References Cited

U.S. PATENT DOCUMENTS 1,824,880 9/1931 Forbes ..... 312/73
2,183,425 12/1939 Fageol ..... 131/234
2,240,215 4/1941 Hutchinson ..... 312/73
2,252,381 8/1941 Ladd ..... 312/73

*Primary Examiner*—Stephen C. Pellegrino
*Attorney, Agent, or Firm*—Oltman and Flynn

[57] ABSTRACT

An arrangement for holding cigarettes has a lower part with an inner hollow and an open end, and an upper part provided with a holding member for holding a plurality of cigarettes. The upper part is movable relative to the lower part between a closed position in which the upper part closes the open end of the lower part and the cigarettes are accommodated in the latter, and an open position in which the upper part is retracted from the lower part and the cigarettes are located outside the latter so as to be exposed.

7 Claims, 13 Drawing Figures

ARRANGEMENT FOR HOLDING CIGARETTES

BACKGROUND OF THE INVENTION

The present invention relates to an arrangement for holding cigarettes.

Arrangements of the above-mentioned general type are known in the art. Known arrangements accommodate cigarettes in closed condition, and when it is needed to withdraw an individual cigarette, a container accommodating the cigarettes is opened by a user. The known arrangements, however, possess some disadvantages. The process of withdrawal of cigarettes from the container is very slow, inconvenient and ineffective. The same is true with respect to the process of closing the container after the withdrawal of the cigarettes. There are also arrangements in which several cigarettes are accommodated and exposed so that several users can take the cigarettes at the same time. These arrangements, however, are not accompanied by ash trays and cigarette lighters. Finally, the known arrangements are bulky and cannot serve as souvenirs.

SUMMARY OF THE INVENTION

Accordingly, it is an object of the present invention to provide a cigarette holding arrangement which avoids the disadvantages of the prior art.

More particularly, it is an object of the present invention to provide an arrangement for holding cigarettes which is more convenient and fast to use and which also includes additional means which are generally utilized in the process of smoking.

Finally, it is an additional object of the present invention to provide an arrangement for holding cigarettes which is compact, operates in an original manner, and can be utilized as a souvenir.

In keeping with these objects, and with others which will become apparent hereinafter, one feature of the present invention resides, briefly stated, in an arrangement which includes a lower part having an inner hollow and an open end, and an upper part provided with means for holding a plurality of cigarettes, wherein the upper part is movable relative to the lower part between a closed position in which the upper part closes the open end of the lower part and the holding means with the cigarettes are accommodated inside the inner hollow of the lower part, and an open position in which the upper part is retracted from the lower part and the holding means with the cigarettes are located outside the lower part.

When the arrangement is designed in accordance with the present invention, it simultaneously provides for exposure of several cigarettes which can be carried out with a high speed and convenience. The process of withdrawal of the cigarettes is also fast and convenient. The arrangement is compact, it operates in an original manner, and it can serve as a souvenir.

All features which are considered as characteristic for the present invention are set forth in a particular appended claims. The invention itself, however, will be best understood from the following description which is accompanied by the following drawings.

DESCRIPTION OF PREFERRED EMBODIMENTS

Figure 1:
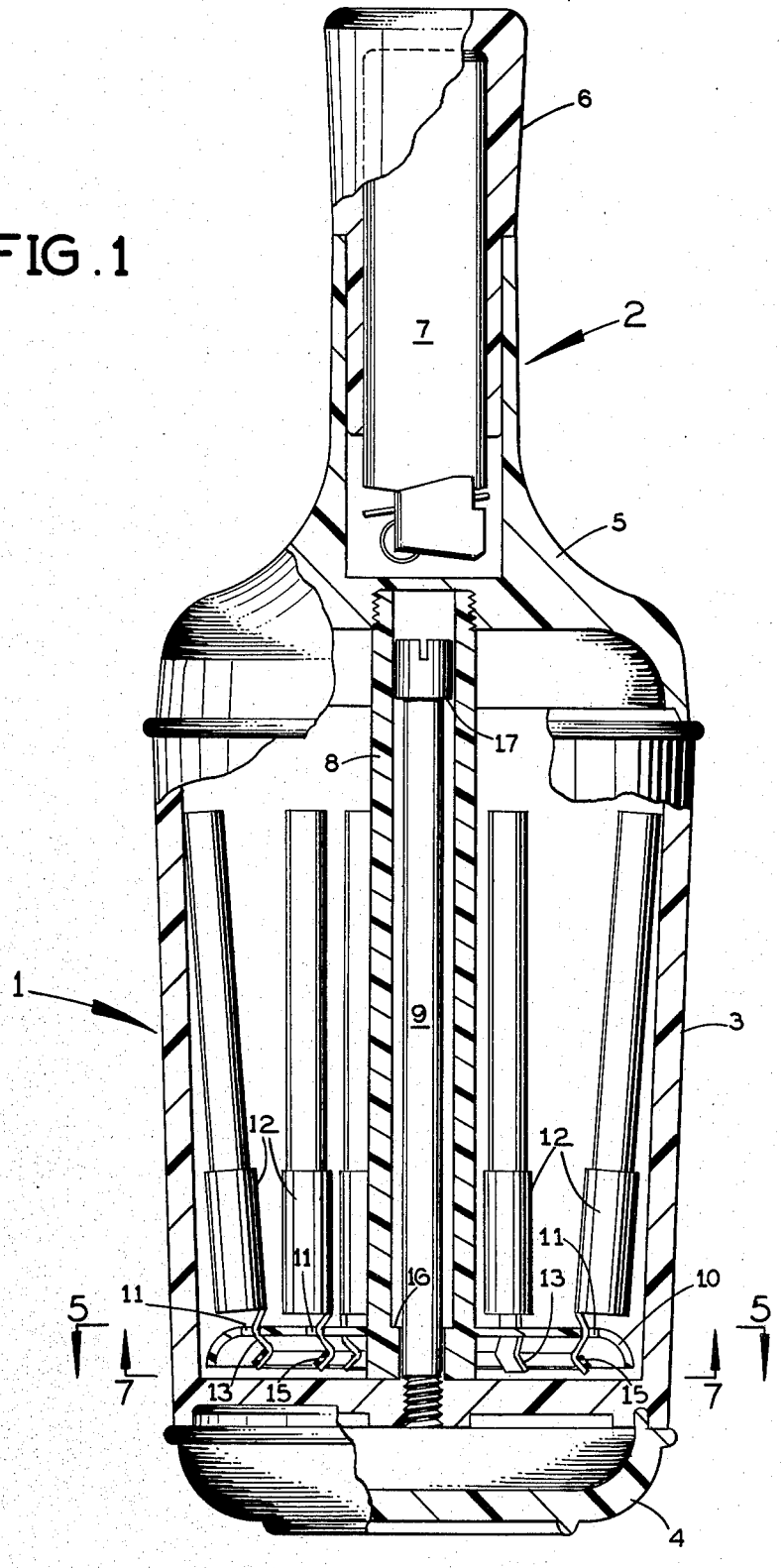
FIG. 1 is a view of a first embodiment of the present cigarette dispenser, partly in side elevation and primarily in longitudinal section, with all of the operating parts in their retracted positions.

An arrangement for holding cigarettes in accordance with the present invention includes a lower part which is identified in toto by reference no. 1 and an upper part which is identified in toto by reference no. 2. The lower part 1 includes a container 3 and a bottom portion 4. The upper part includes a neck 5 and a plug 6. In closed condition shown in FIG. 1, the upper part 2 closes an open end of the lower part 1 by interengaging of projections and grooves provided in these parts.

The bottom 4 of the lower part 1 is formed as an ashtray and detachably connected with the container 3 by interengaging projections and grooves, preferably with snap action. The plug 6 is insertable into the neck 5, preferably with snap action, and accommodates a cigarette lighter 7.

The upper part 2 is provided with a hollow bushing 8, whereas the lower part is provided with a shaft 9 slidingly receivable in the bushing 8. The bushing 8 may be screwed into the neck 5, whereas the shaft 9 may be screwed in the container 3.

The bushing 8 of the upper part 2 is provided with a holding disc 10 having a plurality of openings 11. The arrangement further includes a plurality of cigarette holders which are identified by reference no. 12. Each cigarette holder 12 is formed as a short pipe having a zig-zag projection 13 and an inclined surface 14. As can be seen from FIGS. 1, 2, 5 and 7, the cigarette holders are arranged in two circles having two different diameters. The first group of cigarette holders 12 are arranged at a smaller diameter, whereas the second group of cigarette holders 12 are arranged at a greater diameter.

The projections 13 of the cigarette holders 12 extend through the respective openings 11 of the holding disc 10. Below the holding disc 10 of the cigarette holders of each group are retained by retaining members 15 formed as rubber rings. The rubber rings 15 urge the zig-zag projections 13 toward one another or toward an axis of the arrangement, thereby the cigarette holder 12 tends to move from their vertical position to their inclined position away from one another. In the vertical position shown in FIG. 1, that is when the arrangement is closed, the outer cigarette holders abut against the inner wall of the container 3 and the inner cigarette holders abut against the outer cigarette holders. In the open position shown in FIG. 2, the inclined surfaces 14 of the cigarette holders 12 abut against the holding disc 10.

The bushing 8 is provided with a shoulder 16 which is formed by reduction of an inner opening of the bush 8. The shaft 9 is provided with an outer shoulder 17 which is formed by an enlarged upper portion of the shaft 9. The openings 11 are arranged at two concentrical circles, and the number of the openings 11 is determined in accordance with the required number of cigarettes to be accommodated in the arrangement.

Figure 2:
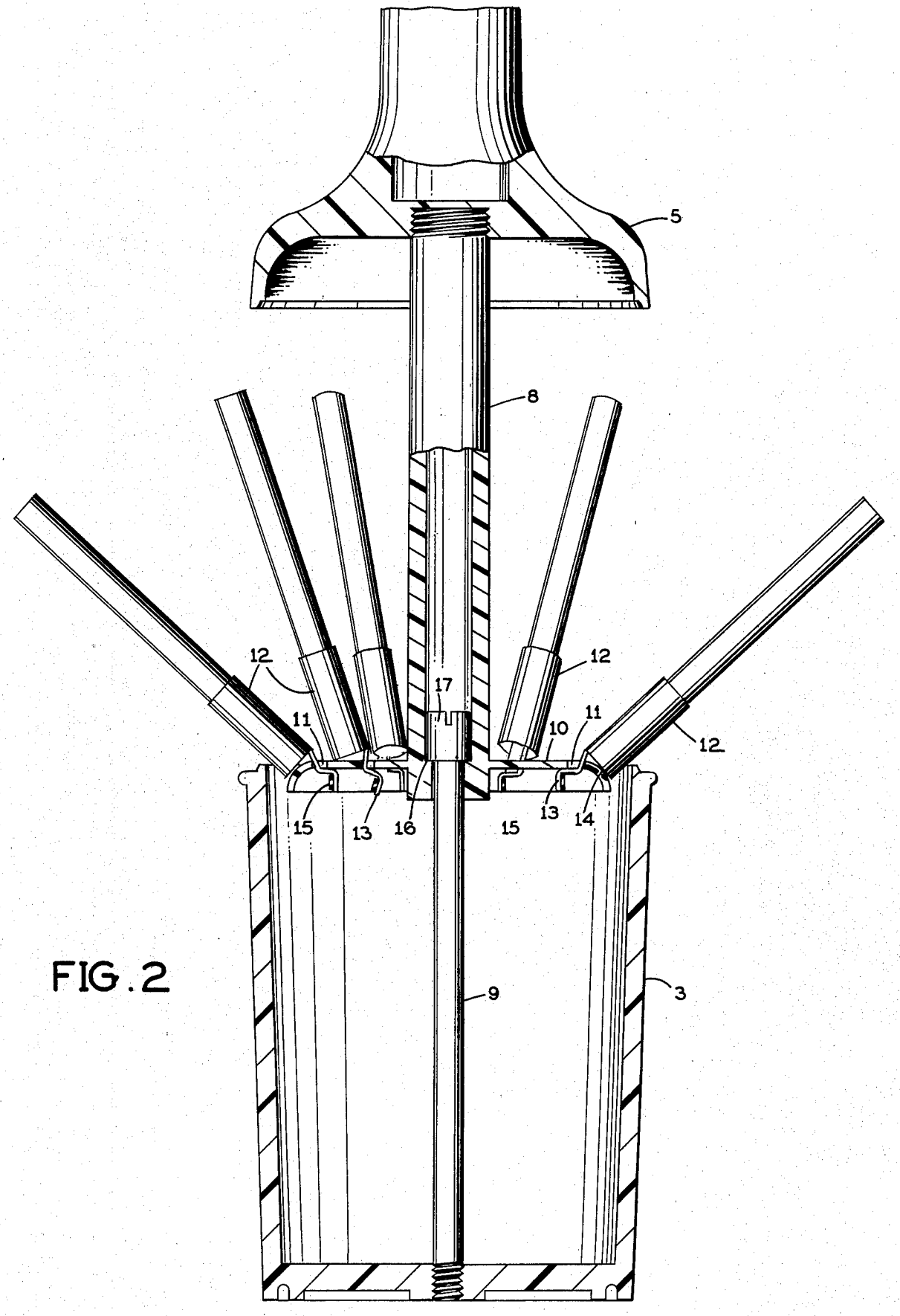
FIG. 2 is a longitudinal sectional view of this embodiment of the cigarette dispenser with the base at the bottom and the plug at the top both omitted and with the other operating parts raised to the cigarette-dispensing position.
Figure 3:
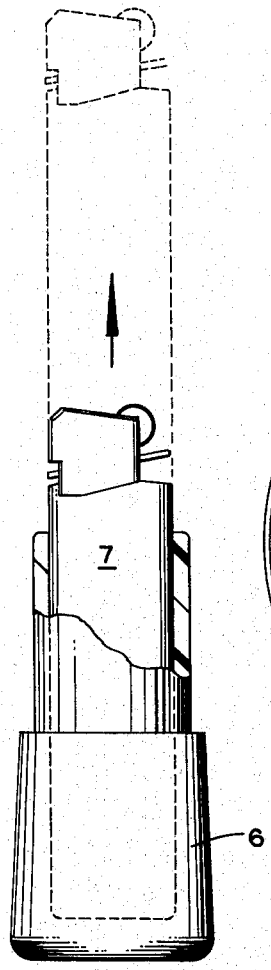
FIG. 3 is a view, partly in side elevation and partly in section, showing the plug and the cigarette lighter removed from the neck of the container, and in phantom showing the lighter removed from the plug.
Figure 4:
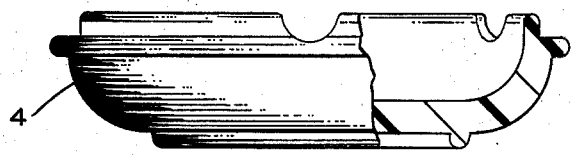
FIG. 4 is a view, partly in side elevation and partly in section, showing the base member removed to serve as an ashtray.
Figure 5:
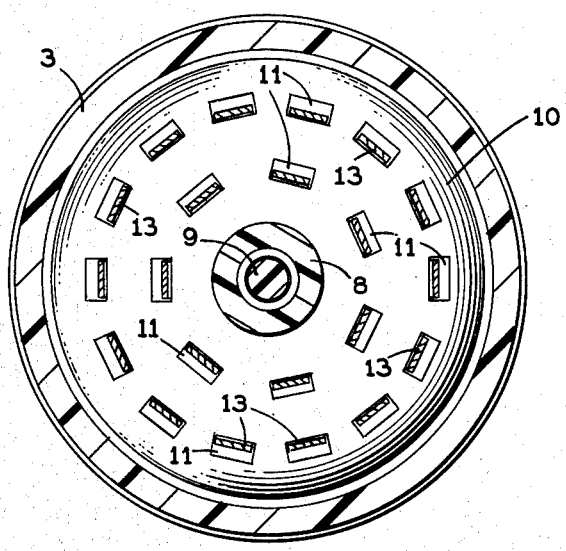
FIG. 5 is a horizontal cross-section taken along the line 5—5 in FIG. 1 at the pivots for the individual cigarette holders in the apparatus.
Figure 8:
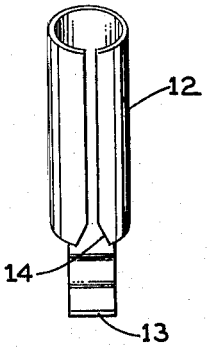
FIG. 8 is an elevational view of one of the individual cigarette holders in this apparatus.
Figure 9:
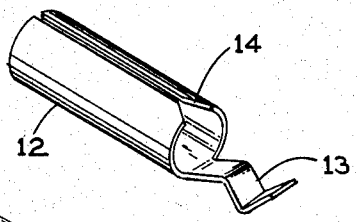
FIG. 9 is a perspective view of this individual cigarette holder.
Figure 7:
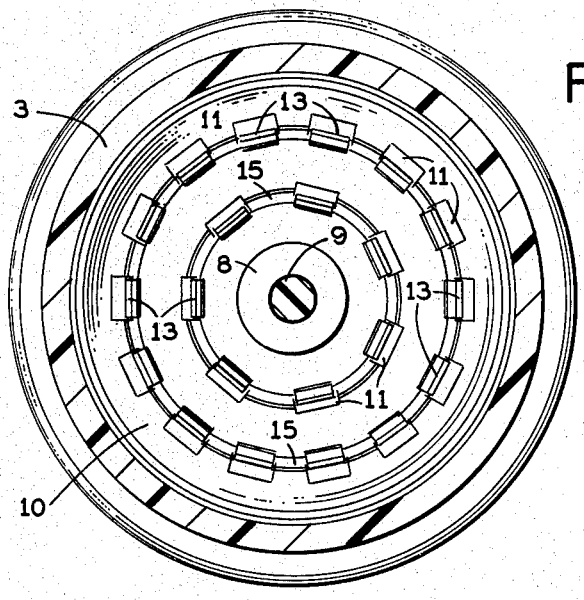
FIG. 7 is a horizontal cross-section taken along the line 7—7 in FIG. 1.
Figure 6:
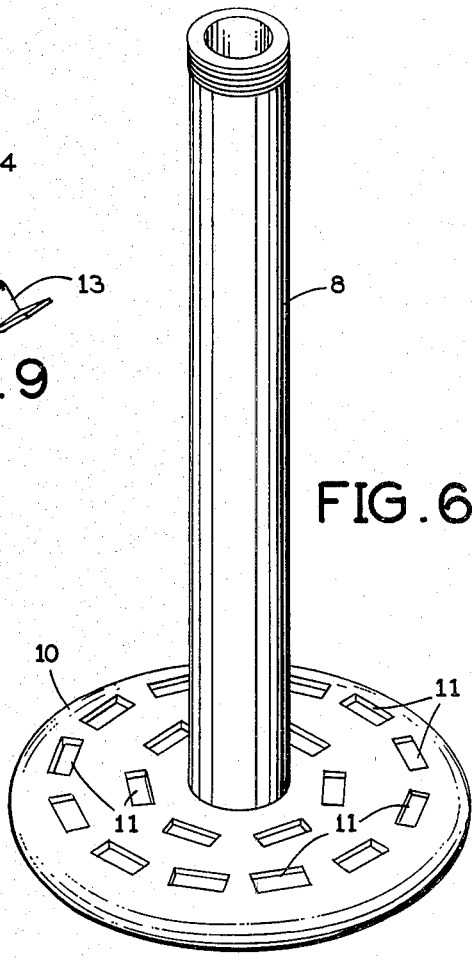
FIG. 6 is a perspective view showing the vertically reciprocable disc and the tube connecting it to the upper container member in the present apparatus.

The arrangement operates in the following manner:

When it is necessary to expose cigarettes, the upper part 2 is moved relative to the lower part 1 accordingly. During this process, the rubberbands 15 urge the cigarette holders 12 towards one another. Since the cigarette holders no longer abut against the inner wall of the container 3 in their upright position, they assume their inclined position spaced from one another, as shown in FIG. 2. The plug 6 is withdrawn from the neck 5 so that the cigarette lighter 7 can light a cigarette released from a respective cigarette holder 12. The bottom 4 is withdrawn from the container 3 and utilized as an ashtray. At the same time, the container 3 can stand upwardly being supported on a lower supporting flange of the container 3, previously serving for connection with the bottom 4. The cigarette lighter 7 can be retained in the plug 6 for lighting purposes. When fuel in the cigarette lighter is spent, it can be replaced. Closing of the arrangement is performed in reverse order.

Figure 10:
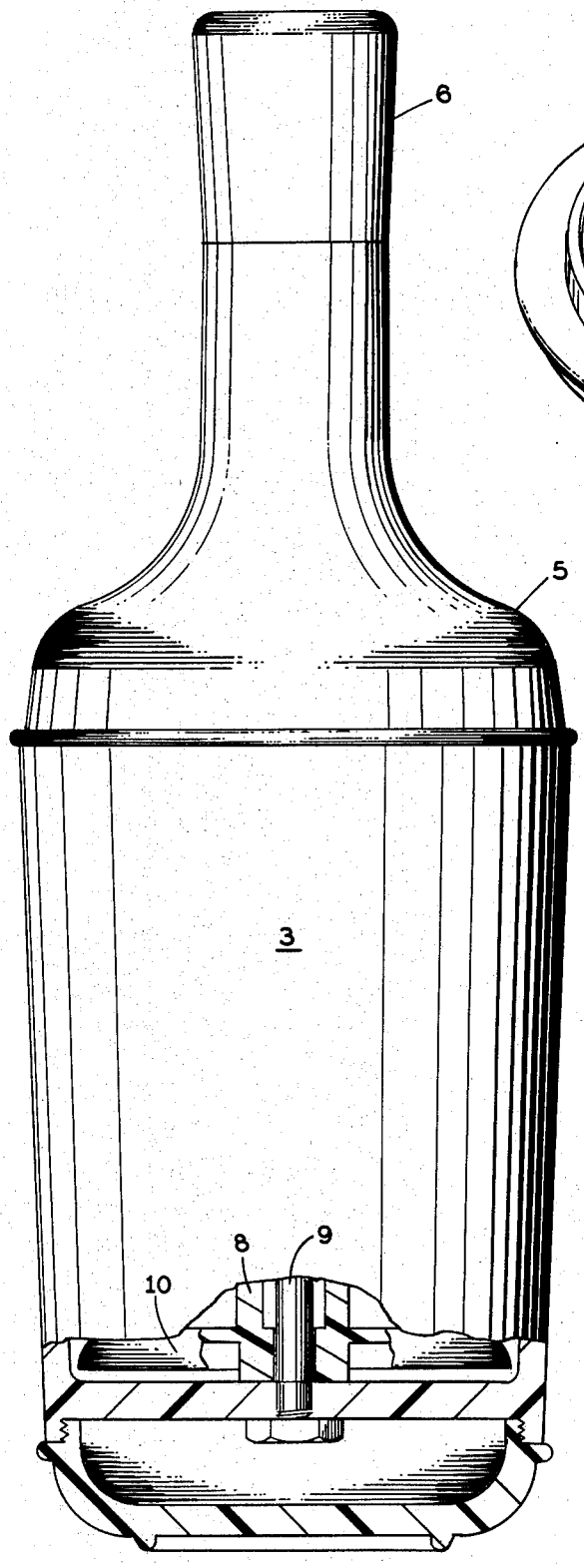
FIG. 10 is a side elevation of a second embodiment of the present cigarette dispenser in its closed position with the lower end broken away for clarity.
Figure 12:
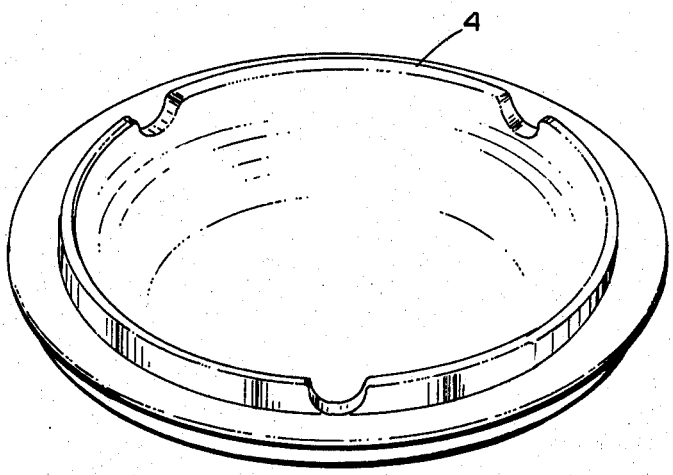
FIG. 12 is a perspective view of the base member serving as an ashtray in this second embodiment.
Figure 11:
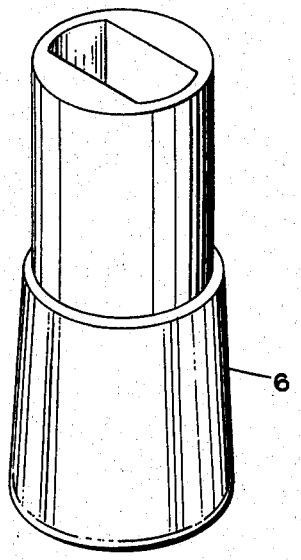
FIG. 11 is a perspective view of the plug in this second embodiment removed from the neck of the container and inverted.
Figure 13:
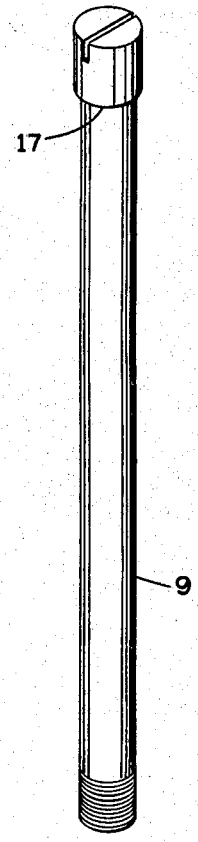
FIG. 13 is a perspective view of the guide post for guiding the up and down movement of the disc and tube sub-assembly in this second embodiment of the invention.

FIG. 10 shows a somewhat different embodiment of the invention. Connection of the ashtray 4 with the container 3 can be performed by a multiple thread, bayonet lock, or by magnet.

A very important feature of the present invention resides in that the upper part 2 with its neck 5 and plug 6 forms together with the lower part 1 with its bottom 4 and container 3 a bottle-like shape. The arrangement imitates a well-known bottle. It can be provided with a wine label which includes information about memorial places, events or dates. The arrangement, with the exception of the ashtray 4 can be manufactured by injection molding of shock-proof polystyrene. Its central shaft may be constituted of capron or polyethylene, whereas the ashtray may be constituted of press powder or aminoplast. The cigarette holders may be stamped of metal.

It will be understood that each of the above described elements may also find a useful application in other types of constructions. Various modifications may be made without departing from the spirit of the present invention. Others by applying current knowledge can adapt it for various applications.

What is claimed as desired to be protected by Latters Patent is set forth in the appended claims:

1. A cigarette dispenser comprising:

a container in the shape of a wine bottle and having a lower annular member terminating at its upper end in an upwardly-facing annular edge, and a separate upper annular member terminating at its lower end in a downward-facing annular edge which releasably engages said upwardly-facing annular edge of said lower annular member, said upper annular member at its upper end presenting an upwardly extending neck of substantially smaller diameter than its downwardly-facing annular edge;

a holding disc received in said lower annular member of the container and movable vertically therein;

means rigidly coupling said upper annular member of said container to said disc to raise and lower said disc along the inside of said lower annular member when said upper annular member is raised and lowered with respect to said lower annular member;

a plurality of tubular cigarette holders mounted on said disc and extending up from the disc, each of said tubular holders being open at the top and shaped and dimensioned to hold the lower end of an individual cigarette;

and spring means acting on said cigarette holders to tilt their upper ends laterally outward when said disc is raised to the upper end of said lower annular member.

2. A cigarette dispenser according to claim 1, wherein:

certain of said cigarette holders are arranged in an annular group close to the inside of said lower annular member of the container;

and said spring means biases the upper ends of said annular group of the cigarette holders laterally outward against the inside of said lower annular member of the container when said disc is in a lowered position inside said lower annular member.

3. A cigarette dispenser according to claim 2, wherein:

said cigarette holders include an additional group of tubular holders mounted on said disc laterally inward from said annular group of holders.

4. A cigarette dispenser according to claim 3, and further comprising:

a plug snugly received inside said neck of said upper annular member of the container and removable through the top of said neck;

a cigarette ligher held in said plug in an inverted position when the plug is in said neck;

and a base member supporting said lower annular member of the container from below and removably attached to said lower annular member, said base member defining a recess which is open at the top for receiving cigarette ashes when said base member is detached from said lower annular member of the container, said lower annular member closing said recess at the top when said base member supports said lower annular member of the container from below.

5. A cigarette dispenser according to claim 2, and further comprising:

a plug snugly received inside said neck of said upper annular member and removable through the top of said neck;

and a cigarette lighter held in said plug in an inverted position when the plug is in said neck.

6. A cigarette dispenser according to claim 1, and further comprising:

a plug snugly received inside said neck of said upper annular member of the container and removable through the top of said neck;

and a cigarette lighter held in said plug in an inverted position when the plug is in said neck.

7. A cigarette dispenser according to claim 1, and further comprising:

a base member supporting said lower annular member of the container from below and removably attached to said lower annular member, said base member defining a recess which is open at the top for receiving cigarette ashes when said base member is detached from said lower annular member of the container, said lower annular member of the container closing said recess at the top when the base member supports said lower annular member from below.

* * * * *